US011148929B2

(12) United States Patent
Gombotz

(10) Patent No.: US 11,148,929 B2
(45) Date of Patent: Oct. 19, 2021

(54) CONNECTOR FOR WATER TANK HAVING A WIRELESS FILLING LEVEL OR CONSUMPTION TRANSMITTER FOR WATER DISPENSER

(71) Applicant: Dietmar Gombotz, Markt Piesting (AT)

(72) Inventor: Dietmar Gombotz, Markt Piesting (AT)

( * ) Notice: Subject to any disclaimer, the term of this patent is extended or adjusted under 35 U.S.C. 154(b) by 0 days.

(21) Appl. No.: 16/625,885

(22) PCT Filed: Jun. 6, 2018

(86) PCT No.: PCT/EP2018/064817
§ 371 (c)(1),
(2) Date: Dec. 23, 2019

(87) PCT Pub. No.: WO2019/001913
PCT Pub. Date: Jan. 3, 2019

(65) Prior Publication Data

US 2020/0148528 A1 May 14, 2020

(30) Foreign Application Priority Data

Jun. 26, 2017 (AT) ..... A 50526/2017

(51) Int. Cl.
*B67D 3/00* (2006.01)

(52) U.S. Cl.
CPC ..... *B67D 3/0032* (2013.01); *B67D 3/0038* (2013.01); *B67D 3/0003* (2013.01);
(Continued)

(58) Field of Classification Search
CPC .... G08B 19/00; G05D 7/0617; B67D 3/0032; B67D 3/0035; B67D 3/0038;
(Continued)

(56) References Cited

U.S. PATENT DOCUMENTS 4,001,801 A * 1/1977 Moulet ..... A61M 5/1689 137/487.5
4,795,060 A * 1/1989 Albrecht ..... G01F 13/006 222/17

(Continued)

FOREIGN PATENT DOCUMENTS

CN 1408105 A 4/2003
CN 200984103 Y 12/2007

(Continued)

OTHER PUBLICATIONS

International Application No. PCT/EP2018/064817, International Search Report dated Aug. 28, 2018, 5 pages.

(Continued)

*Primary Examiner* — Patrick M. Buechner
(74) *Attorney, Agent, or Firm* — Liang & Hennessey LLP; Brian Hennessey

(57) ABSTRACT

The invention relates to a water dispenser intermediate part, wherein the water dispenser intermediate part has first connecting means for connecting a water tank to the water dispenser intermediate part, and the water dispenser intermediate part has second connecting means for connecting the water dispenser intermediate part to a water dispenser device. The water dispenser intermediate part has a water pipe piece which connects the first connecting means to the second connecting means. The water dispenser intermediate part has a water consumption meter and/or a water level sensor for determining water consumption via the water pipe and/or a water level in the water container, The water dispenser intermediate part has at least one transmitter part for wireless transmission of water consumption values and/or water level reports from the water tank.

20 Claims, 1 Drawing Sheet

(52) U.S. Cl.
CPC ..... *B67D 3/0077* (2013.01); *B67D 3/0093* (2013.01); *B67D 2210/00089* (2013.01); *B67D 2210/00097* (2013.01)

(58) Field of Classification Search
CPC .. B67D 3/0041; B67D 3/0054; B67D 3/0003; B67D 3/0077; B67D 3/0093; B67D 2210/00089; B67D 2210/00091; B67D 2210/00097; B67D 2210/00047; B67D 2210/00049
USPC .... 700/231, 240, 244; 222/146.1, 146.6, 77, 222/325–327, 185.1, 14–23, 25–28, 30, 222/58–59, 61, 63
See application file for complete search history.

(56) References Cited

U.S. PATENT DOCUMENTS 4,846,236 A * 7/1989 Deruntz ..... B67B 7/28 141/329
6,636,151 B2 * 10/2003 Busick ..... B67D 3/0032 340/521
8,281,821 B2 * 10/2012 Spear ..... B67D 3/0032 141/82
8,356,731 B2 * 1/2013 Xiao ..... B67D 3/0083 222/67
10,563,909 B2 * 2/2020 Scalf ..... B67D 1/1202
10,670,444 B2 * 6/2020 Gurumohan ..... G01S 15/88
2002/0101346 A1 8/2002 Busick
2007/0125795 A1 * 6/2007 Ernes ..... G07F 13/02 222/2
2009/0242585 A1 * 10/2009 Wang ..... B67D 3/0032 222/14
2014/0239013 A1 * 8/2014 Santos ..... B67D 3/0032 222/146.6
2014/0263429 A1 * 9/2014 Keating ..... B67D 3/0006 222/54
2014/0263430 A1 * 9/2014 Keating ..... B67D 3/0003 222/54
2017/0087524 A1 * 3/2017 Deshpande ..... B01F 15/0215
2017/0108880 A1 * 4/2017 Kim ..... G06Q 20/208
2019/0093942 A1 * 3/2019 Scalf ..... B67D 3/0003
2019/0186649 A1 * 6/2019 Warren ..... G05D 7/0605
2020/0031656 A1 * 1/2020 Rudick ..... G06F 3/013

FOREIGN PATENT DOCUMENTS

CN 105073629 A 11/2015
CN 105595838 A 5/2016
DE 3509189 C1 5/1986
DE 202015000948 U1 2/2015
WO 0220392 A1 3/2002

OTHER PUBLICATIONS

Austria Application No. A 50526/2017, Office Action dated Apr. 13, 2018, 2 pages.
International Application No. PCT/EP2018/064817, International Preliminary Examination Report dated Aug. 28, 2018, 10 pages.
Chinese Application No. 201880041409.4, Office Action dated Apr. 1, 2021, 13 pages.

* cited by examiner

CONNECTOR FOR WATER TANK HAVING A WIRELESS FILLING LEVEL OR CONSUMPTION TRANSMITTER FOR WATER DISPENSER

CROSS-REFERENCE TO RELATED APPLICATIONS

The present application is a national phase application of PCT Application No. PCT/EP2018/064817, filed Jun. 6, 2018, entitled "CONNECTOR FOR WATER TANK HAVING A WIRELESS FILLING LEVEL OR CONSUMPTION TRANSMITTER FOR WATER DISPENSER", which claims the benefit of Austrian Patent Application No. A 50526/2017, filed Jun. 26, 2017, each of which is incorporated by reference in its entirety.

BACKGROUND OF THE INVENTION

1. Field of the Invention

The invention concerns an intermediate part of a water dispenser.

2. Description of the Related Art

Water dispensers, mostly in the form of free-standing or self-sufficient devices, are known to be increasingly installed in places frequented by a large number of people. Such water dispensers can be found especially in public authorities, offices and other institutions, but also in shops and department stores. The water of these water dispensers comes from water tanks, which are inserted into the water dispensers at the top of most models. An advantage of such known water dispensers is that they operate in a self-sufficient manner and can be installed as required without special restrictions. Due to the quite simple technology of such water dispensers, they have a long service life, which is usually greater than 15 years and which can also be 30 years.

A disadvantage of such water dispensers is that their water consumption depends on the amount of water drawn and is therefore difficult to predict. Most of the water dispensers are serviced by companies responsible for this purpose, and the water tanks are exchanged or replaced. Due to the unpredictable water level situation, an unnecessary exchange of a water tank within the scope of a maintenance date determined in advance can occur as well as an empty water dispenser.

It can be argued against water dispensers which are able to record the residual water level in the connected water tank themselves and to send corresponding messages regarding a replacement that the replacement of conventional water dispensers which are in themselves fully operational would be necessary. In addition to the acquisition costs of new water dispensers, electrical devices have a considerably reduced service life and a higher susceptibility to faults compared to mechanically simple water dispensers. On the basis of the current availability and lifetime of electronic components, it must be assumed that within 10 to 15 years after the introduction of an electronic product, spare parts supply, in particular for ICs and μPS, can no longer be guaranteed. Should a component defect therefore occur, such devices can become irreparable within a short service life of the device per se. In addition, such devices use certain telecommunication standards for data transmission. Due to the continuous improvement and change of such standards, such fully equipped water dispensers will sooner or later no longer be able to communicate as intended, either because a certain transmission standard is no longer supported by the network operators, or because entire networks are taken out of service, as has often been the case in the past. Although water dispensers from the late 1980s are still in use, when the German C-network was the widespread mobile radio standard, the C-networks concerned were completely switched off and dismantled, and no downward-compatible successor technology is available.

It is therefore the object of the invention to provide a water dispenser intermediate part of the type mentioned at the beginning, with which the mentioned disadvantages can be avoided, with which the security of water supply of a water dispenser can be improved with little effort, and which does not limit the service life of the water dispenser.

SUMMARY OF THE INVENTION

According to the invention, this is achieved by a water dispenser intermediate part including first connecting means for connecting a water tank to the water dispenser intermediate part and second connecting means for connecting the water dispenser intermediate part to a water dispenser device. The water dispenser intermediate part also includes a water pipe piece connecting the first connecting means to the second connecting means and a water consumption meter and/or a water level sensor for determining a water consumption via the water pipe piece and/or a water level in the water tank. The water dispenser intermediate part further includes at least one transmitter part for wireless transmission of water consumption values and/or water level messages of the water tank.

This allows existing water dispensers to be retrofitted in such a way that they can at least send reports to a service company or other interested party regarding the amount of water dispensed or the water level in the water tank of the water dispenser. In this way, a situation can be avoided in which a water dispenser no longer has any water available for delivery in an unrecognized way by sending a corresponding message to an employee or company entrusted with the exchange of the water tank at the latest when a predefinable residual quantity in the water tank has been reached.

This can also be used to send additional information concerning the operation or operating status of the water cooler, such as the operation according to an intended function, or the water temperature. This makes it possible to retrofit already existing and still reliable devices easily and with little effort. Since it is not necessary to transport the water dispenser itself, since the water dispenser intermediate part can simply be attached on site to an already installed water dispenser, the environment is also protected. In the event of a defect in the water dispenser intermediate part, it can be replaced easily, quickly and without complications. Even in the event of a total failure of the water dispenser intermediate part, it is still possible to remove water. A combination of water dispenser and intermediate water dispenser can be easily adapted to changing technical conditions, such as a changing telecommunications environment, by simply replacing an existing water dispenser intermediate part with a new water dispenser intermediate part adapted to the current state of transmission technology, without having to make any changes to the water dispenser itself. This makes it possible to operate a water dispenser throughout its entire service life without restriction, wherein additional functions can be kept up to date by adapting or replacing the water dispenser intermediate part.

This allows a change of a service provider who services certain water dispensers to be made simply by changing the water dispenser intermediate parts.

The subclaims relate to further advantageous embodiments of the invention.

Express reference is hereby made to the wording of the patent claims, wherein the claims are inserted here by reference in the description and are deemed to be reproduced verbatim.

BRIEF DESCRIPTION OF THE DRAWINGS

The invention is described in more detail with reference to the enclosed drawings, in which only preferred embodiments are shown by way of example, wherein.

DETAILED DESCRIPTION

Figure 1:
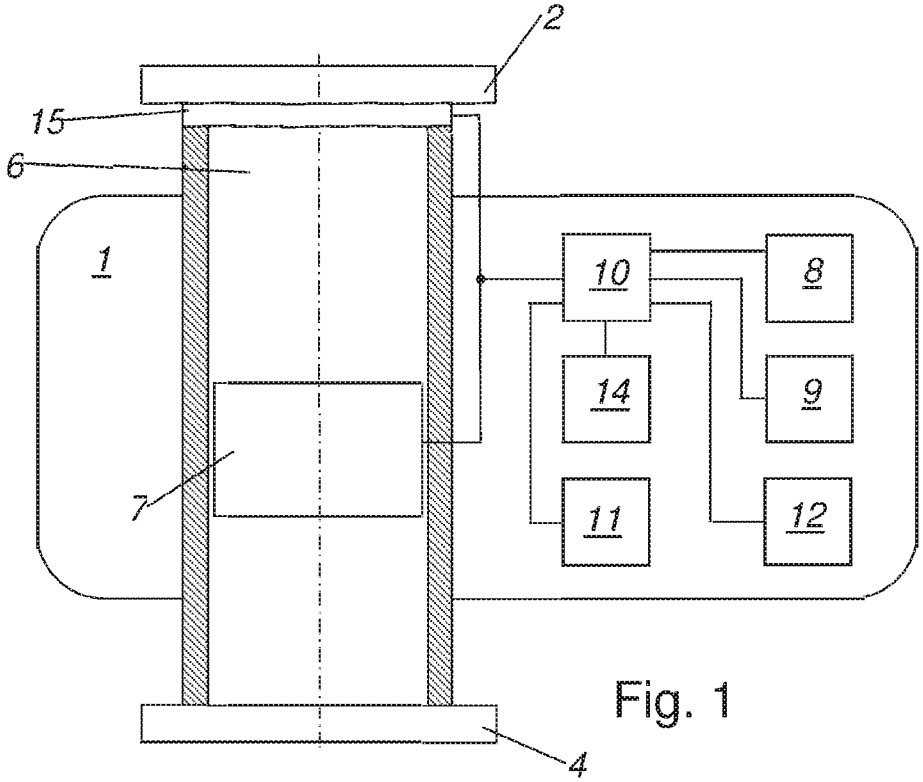
FIG. 1 shows a schematic representation of an embodiment of a subject water dispenser intermediate part.

The FIG. 1 shows a schematic representation of a water dispenser intermediate part 1, wherein the water dispenser intermediate part 1 comprises first connecting means 2 for connecting a water tank 3 to the water dispenser intermediate part 1, wherein the water dispenser intermediate part 1 comprises second connecting means 4 for connecting the water dispenser intermediate part 1 to a water dispenser 5, wherein the water dispenser intermediate part 1 comprises a water pipe piece 6, which connects the first connecting means 2 to the second connecting means 4, wherein the water dispenser intermediate part 1 has a water consumption meter 7 and/or a water level sensor 15 for determining a water consumption via the water pipe piece 6 and/or a water level in the water tank 3, wherein the water dispenser intermediate part 1 has at least one transmitter part 8, 9 for wireless transmission of water consumption values and/or water level messages of the water tank 3.

This allows existing water dispenser devices 5 to be retrofitted in such a way that they can at least send reports to a service company or another interested party regarding the quantity of water dispensed or the water level in the water tank 3 of the water dispenser. This can prevent a situation in which a water dispenser is unrecognizably out of water for delivery by sending a message to an employee or company responsible for exchanging the water tank 3, at the latest when a predefinable residual quantity in the water tank 3 has been reached.

This also allows further information concerning the operation or operating status of the water dispenser 5, such as the operation according to an intended function, or the water temperature, to be transmitted. This makes it possible to retrofit already existing and still reliable devices easily and with little effort. As it is not necessary to transport the water dispenser 5 itself, as the water dispenser intermediate part 1 can simply be attached on site to a water dispenser 5 that has already been installed, the environment is also protected. If the water dispenser intermediate part 1 is defective, it can be replaced easily, quickly and without complications. Even in the event of a total failure of the water dispenser intermediate part 1, it is still possible to withdraw water. A combination of water dispenser 5 and water dispenser intermediate part 1 can easily be adapted to changing technical conditions, such as a changed telecommunications environment, by simply replacing an existing water dispenser intermediate part 1 with a new water dispenser intermediate part 1 adapted to the current state of transmission technology, without having to modify the water dispenser 5 itself. This makes it possible to operate a water dispenser 5 over its entire service life without restriction, wherein additional functions can be kept up to date by adapting or replacing the water dispenser intermediate part 1.

Figure 2:
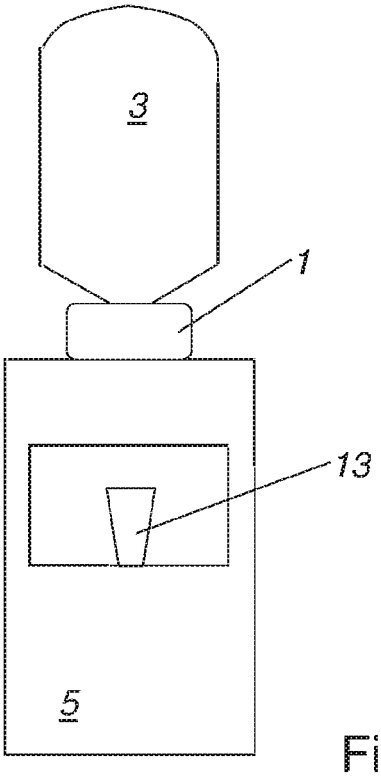
FIG. 2 shows a schematic representation of an arrangement of water reservoir with drinking vessel, water dispenser intermediate part and water tank.

The water dispenser intermediate part 1 in question is intended to be arranged between a water tank 3 or water reservoir, which is designed as a transparent plastic container with a capacity of for example 3 to 15 liters, and a water dispenser 5, which is also called water dispenser device 5 synonymously in this case. FIG. 2 shows a schematic representation of such an arrangement. In addition to the water dispenser 5, the water tank 3 and the water dispenser intermediate part 1, a drinking vessel 13 is also shown, which is arranged in a water withdrawal opening of the water dispenser 5.

The water dispenser intermediate part 1 has first connecting means 2 for connecting a water tank 3 to the water dispenser intermediate part 1. The first connecting means 2 are designed to be essentially watertight, and preferably correspondingly diametrically opposed to the connecting means of a water tank 3 to be arranged. The first connecting means 2 are designed to approximately comprise a screw thread and at least one sealing ring.

The water dispenser intermediate part 1 also has second connecting means 4 for connecting the water dispenser intermediate part 1 to a water dispenser device 5. The second connecting means 4 are also preferably designed to be watertight and correspondingly diametrically opposed to the connecting means of a water dispenser 5. The second connecting means 4 are designed to approximately comprise a screw thread and at least one sealing ring. It is preferably provided that the first connecting means 2 and the second connecting means 4 are designed in such a way that a release resistance of the first connecting means 2 is lower than a release resistance of the second connecting means 4. This can be achieved so that the connection between the water dispenser intermediate part 1 and the water dispenser 5 is not opened when the water tank 3 is replaced. Release resistance is designated as the resistance to the initial release of the corresponding fixed connection. With the preferred design of the two connecting means 2, 4 including screw threads, this would mean that the maximum required torque at the second connecting means 4 would be greater than the corresponding torque at the first connecting means 2.

It is particularly preferably provided that a mechanical locking device is associated with the second connecting means 4, which mechanical locking device requires a tool, in particular a special or not commonly available tool, for separating the connection between the second connecting means 4 and the water dispenser 5.

In accordance with a preferred embodiment, it is provided that the first connecting means 2 has a closure opening projection, which closure opening projection is designed and arranged in such a way that in the course of the arrangement of a water tank 3 at the first connecting means 2 a closure of the water tank 3, in particular a sealing film, is opened, in particular severed or pierced. This ensures that the water tank 3 is also opened when the water tank 3 is attached to the water dispenser intermediate part 1. Such a closure opening projection is known from rotary closures in beverage cartons, for example, in which a foil-like fresh seal is simultaneously punctured or opened during the first opening process.

Between the first connecting means 2 and the second connecting means 4 a water pipe piece 6 of the water dispenser intermediate part 1 is arranged. The water pipe piece 6 is arranged as a pipe or hose.

The water dispenser intermediate part 1 has at least one water consumption meter 7 for determining water consumption via the water pipe section 6. The water consumption meter 7 can be designed differently, wherein the flow volume quantity or the flow mass quantity is recorded by the water tank 3 in the water dispenser 5. It is preferably provided that the water consumption meter 7 is designed to include a mechanical meter, in particular an impeller flowmeter, which makes it particularly easy to implement a water dispenser intermediate part 1. According to a further embodiment, it is provided that the water consumption meter 7 is formed by means of a flow meter without mechanical, movable components within the water pipe section 6, wherein the susceptibility to contamination can be reduced. Other types of water consumption meter 7 may also be provided.

In accordance with a particularly preferred embodiment, it is provided that the water dispenser intermediate part 1—in addition or alternatively to the water consumption meter 7—has at least one water level sensor 15 for determining a water consumption via the water pipe section 6 and/or a water level in the water tank 3. It is preferably provided that the water level sensor 15 is designed to include a weighing device. In particular, any form of weight or mass sensor is regarded as a weighing device. Weighing devices or corresponding sensors are known in different embodiments. The water level sensor 15 is arranged on the water dispenser intermediate part 1 in such a way that it is possible to weigh the water tank 3. In particular, it is provided that the water level sensor 15 is arranged in the area of the first connecting means 2. In this context, it may be provided that the empty mass of a water tank 3 or different water tanks 3 is stored in the water dispenser intermediate part 1.

Preferably, the water dispenser intermediate part 1 has a control and/or monitoring unit 10, which is preferably formed comprising at least one microprocessor or microcontroller. The control and/or monitoring unit 10 is operatively connected to the water consumption meter 7 or the water level sensor 15 or forms part of the water consumption meter 7 or the water level sensor 15, for example by automatically storing the meter reading when the water tank 3 is replaced and only determining the deviating relative quantity, or by the control and/or monitoring unit 10 carrying out the actual counting process. Furthermore, at least one I/O interface and/or at least one memory module can be assigned to the control and/or monitoring unit 10.

The water dispenser intermediate part 1 preferably has an internal power supply 14, which supplies the control and/or monitoring unit 10 and other components of the water dispenser intermediate part 1 with electrical energy. It may be provided that the power supply 14 is designed to be independent of the mains current, preferably comprising an accumulator, and/or that the power supply 14 is designed to comprise a so-called power supply unit, in particular a switching power supply unit, as a result of which a locally available mains connection can optionally be used.

The water dispenser intermediate part 1 has at least one transmitter part 8, 9 for wireless transmission of water consumption values and/or water level messages from the water tank 3. In accordance with the preferred embodiment, it is provided that the water dispenser intermediate part 1 has a first transmitter part 8 and a second transmitter part 9, which are each designed for data transmission according to different standards or transmission protocols.

The at least one transmitter part 8, 9 is at least indirectly connected to the control and/or monitoring unit 10, therefore connected to it by circuitry.

Preferably, at least one transmitter part 8, 9 is designed as a bidirectional radio interface, wherein control data or software updates, for example for the control and/or monitoring unit 10, can also be received. Alternatively, in environments where radio communication is problematic, for example, data transmission using infrared or ultrasound can also be provided. It is also preferably provided that the at least one transmitter part 8, 9 be used for the data transmission in accordance with GSM and/or GPRS and/or EDGE and/or UMTS and/or CDMA2000 and/or LTE and/or for data transmission in accordance with at least one of the standards in accordance with IEEE 802, in particular IEEE 802.11, therefore so-called W-LAN. This allows existing infrastructure to be used.

Preferably it is also provided that the water dispenser intermediate part 1 has at least one line-bound interface 12, in particular in accordance with the USB standard and/or Ethernet, which interface 12 is at least indirectly connected to the control and/or monitoring unit 10. If a network connection is available in the area where the water dispenser 5 is installed, this can also be used for communication with the water dispenser intermediate part 1. However, such an interface can also only be used for a configuration of the water dispenser intermediate part 1, for example in the course of maintenance or new installation.

According to a preferred further development it is provided that the water dispenser intermediate part 1 has at least one display 11, which display 11 is at least indirectly connected to the control and/or monitoring unit 10. This makes it possible not only to read out status or problem reports from the control and/or monitoring unit 10, but also, for example, to display advertising content, which can generate additional income with a water reservoir. In addition, passers-by can be encouraged to drink. This can improve the health of older people in particular, who usually forget to drink.

The invention claimed is:

1. A water dispenser intermediate part, comprising:

a first connecting arrangement for connecting a water tank to the water dispenser intermediate part;

a second connecting arrangement for connecting said water dispenser intermediate part to a water dispenser device;

a fluid flow arrangement connecting the first connecting arrangement to the second connecting arrangement;

at least one of a water consumption meter and a water level sensor for determining a water consumption via at least one of the fluid flow arrangement and a water level in the water tank; and at least one transmitter part for wireless transmission of at least one of water consumption values and water level messages of the water tank.

2. The water dispenser intermediate part according to claim 1, wherein the first connecting arrangement and the second connecting arrangement have a first release resistance of the first connecting arrangement is lower than a second release resistance of the second connecting arrangement.

3. The water dispenser intermediate part according to claim 1, wherein the at least one transmitter part is designed as a bidirectional radio interface.

4. The water dispenser intermediate part according to claim 1, wherein the water level sensor is formed comprising a weighing device.

5. The water dispenser intermediate part according to claim 1, wherein the second connecting arrangement comprises a mechanical locking device, the mechanical locking device adapted to require a tool to release the water dispenser intermediate part from the water dispenser device.

6. The water dispenser intermediate part according to claim 1, wherein the at least one transmitter part is designed for data transmission according to at least one of:

at least one of GSM, GPRS, EDGE, UMTS, CDMA2000, and LTE; and at least one of the standards according to IEEE 802.

7. The water dispenser intermediate part according to claim 6, wherein the at least one transmitter part is designed for data transmission according to IEEE 802.11.

8. The water dispenser intermediate part according to claim 1, wherein the water consumption meter is designed as a mechanical meter.

9. The water dispenser intermediate part according to claim 8, wherein the mechanical meter is an impeller flowmeter.

10. The water dispenser intermediate part according to claim 1, wherein:

the first connecting arrangement comprises a first screw thread; and the second connecting arrangement comprises a second screw thread.

11. The water dispenser intermediate part according to claim 10, wherein:

the first release resistance is a first torque;

the second release resistance is a second torque; and the first torque is lower than the second torque.

12. The water dispenser intermediate part according to claim 1, wherein the first connecting arrangement has a closure opening projection, which closure opening projection is designed and arranged in such a way that, in the course of the arrangement of a water tank on the first connecting arrangement, a closure of the water tank is opened.

13. The water dispenser intermediate part according to claim 12, wherein the closure of the water tank comprises a sealing film.

14. The water dispenser intermediate part according to claim 12, wherein the closure of the water tank is opened by severing.

15. The water dispenser intermediate part according to claim 1, wherein the water dispenser intermediate part has at least one of a control and a monitoring unit comprising at least one microprocessor or microcontroller, and the at least one of the control and the monitoring unit is operatively connected to the at least one of the water consumption meter and the water level sensor or forms part of the at least one of the water consumption meter and the water level sensor.

16. The water dispenser intermediate part according to claim 15, wherein the at least one transmitter part is connected at least indirectly to the at least one of the control and the monitoring unit.

17. The water dispenser intermediate part according to claim 15, wherein the water dispenser intermediate part has at least one display, which display is connected at least indirectly to the at least one of the control and the monitoring unit.

18. The water dispenser intermediate part according to claim 17, wherein the at least one display is viewable during water dispensing.

19. The water dispenser intermediate part according to claim 15, wherein the water dispenser intermediate part has at least one line-bound interface, which interface is at least indirectly connected to the at least one of the control and the monitoring unit.

20. The water dispenser intermediate part according to claim 19, wherein the at least one line-bound interface operates according to the USB standard.

* * * * *